US006784383B2

(12) United States Patent
Sugahara et al.

(10) Patent No.: US 6,784,383 B2
(45) Date of Patent: Aug. 31, 2004

(54) ROTARY ENCODER

(75) Inventors: Jun Sugahara, Okayama (JP); Jun Sato, Okayama (JP); Kenji Kataoka, Okayama (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/601,661

(22) Filed: Jun. 24, 2003

(65) Prior Publication Data

US 2004/0035688 A1 Feb. 26, 2004

(30) Foreign Application Priority Data

Jun. 25, 2002 (JP) ..... 2002-183904

(51) Int. Cl.[7] ..... H01H 9/30

(52) U.S. Cl. ..... 200/11 R; 200/14; 200/11 DA; 200/17 R

(58) Field of Search ..... 200/11 R, 11 G, 200/11 A, 11 D, 11 DA, 11 TW, 17 R, 14, 18

(56) References Cited

U.S. PATENT DOCUMENTS 4,392,030 A * 7/1983 Buss ..... 200/11 R
4,625,084 A * 11/1986 Fowler et al. ..... 200/11 DA
4,652,947 A * 3/1987 Oka et al. ..... 360/85
5,017,741 A * 5/1991 Brown et al. ..... 174/260
5,438,172 A * 8/1995 Fowler et al. ..... 200/11 R
5,794,766 A * 8/1998 Morita et al. ..... 200/569
6,340,801 B1 * 1/2002 Fukuda et al. ..... 200/18
6,388,211 B1 * 5/2002 Nomura et al. ..... 200/11 DA

FOREIGN PATENT DOCUMENTS

JP 3-26021 3/1991
JP 6-94476 4/1994

* cited by examiner

*Primary Examiner*—Kyung Lee
(74) *Attorney, Agent, or Firm*—Wenderoth, Lind & Ponack, L.L.P.

(57) ABSTRACT

A rotary encoder having a slider provided with a plurality of movable contact points disposed along a circle of a certain radius at an angular interval six times as large as an output pitch of rectangular wave signal. The contact-point board is provided on the surface with a signal pattern and a common pattern. Signal pattern consists of three fixed contact points, each having two conductive layers of radial shape of the same width, disposed at an angular pitch which is three times as large as the output pitch of rectangular wave signal. These fixed contact points are disposed along sliding circle of the movable contact points, at an angular pitch which is smaller, or larger, than angular interval of movable contact points, or a multiple of it, by the output pitch of rectangular wave signal, or twice that. Common pattern is disposed insulated from the signal pattern. Overall size of the rotary encoder is small in the outer diameter, and the encoder generates three-phase rectangular wave signal.

4 Claims, 21 Drawing Sheets

ROTARY ENCODER

TECHNICAL FIELD

The present invention relates to a rotary encoder that outputs three-phase rectangular wave signals, used for input operations, etc. in various kinds of electronic apparatus.

BACKGROUND ART

A conventional rotary encoder which outputs multi-phase rectangular wave signals is disclosed in Japanese Utility Model Laid-Open No. H3-26021, and in Japanese Patent Laid-Open Application No. H6-94476. Each of the conventional rotary encoders has a ring-shape common pattern disposed at the center of contact-point board, and a teethed ring-shape signal pattern disposed around outside of the common pattern. The signal pattern is provided for a number of phases of the output signal, disposed concentric to the common pattern. Each of the rotary encoders further has a slider, provided to be revolvable so that its movable contact points slide on the respective patterns to generate multi-phase rectangular wave signals. For example, a three-phase encoder is provided with three signal patterns. The contact-point boards used in conventional rotary encoders have large outer diameter. Therefore, the overall outer dimensions of the rotary encoder become bulky, and this makes it difficult to use the rotary encoder in a high-density compact electronic apparatus.

DISCLOSURE OF INVENTION

A rotary encoder in the present invention has a slider supported to be revolvable with respect to a contact-point board, which slider having a plurality of movable contact points disposed on a circle of a certain radius from the revolution center at an angular interval that is six times as large as the output pitch of rectangular wave signal. The rotary encoder further has, on the contact-point board, an electroconductive signal pattern and a common pattern, which make contact with the slider. The signal pattern has three fixed contact points along a sliding circle of the movable contact points. Each of the fixed contact points has two conductive layers of the same width disposed in radial arrangement having mutual electrical conduction. Angular pitch of the radial conductive layers is three times as large as the output pitch of rectangular wave signal. Angular pitch of the three fixed contact points is smaller, or larger, than the angular interval, or a multiple of it, of the movable contact points by the output pitch of rectangular wave, or twice that. Furthermore, it is larger than angular width of one of the fixed contact point. The common pattern is insulated from the signal pattern, and disposed on a sliding circle of the same radius as the movable contact points of slider. When any one of the movable contact points of the slider is making contact with any one of the fixed contact points of signal pattern, the common pattern is having contact with at least one of the rest of the movable contact points.

DETAILED DESCRIPTION OF PREFERRED EMBODIMENTS (Embodiment 1)

Figure 1:
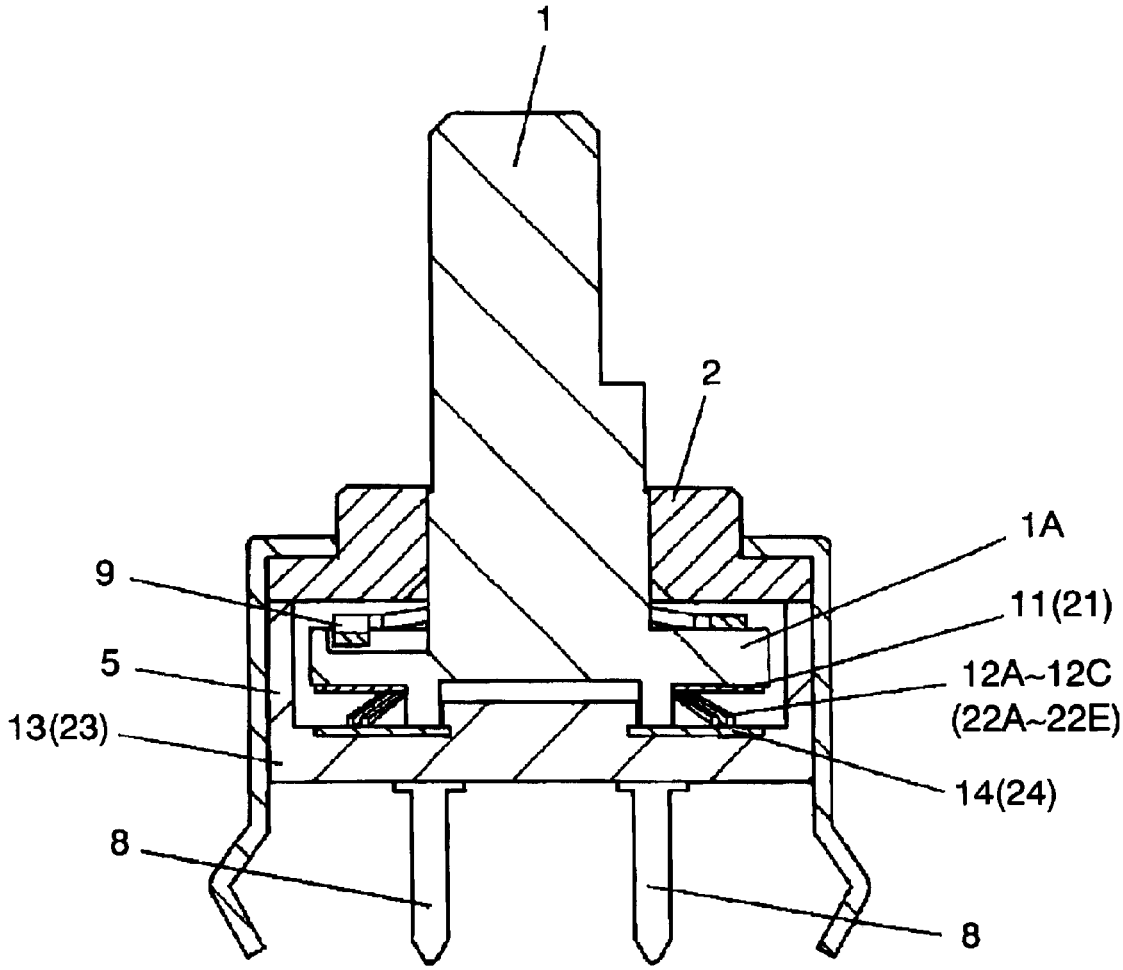
FIG. 1 is a cross sectional side view of a rotary encoder in accordance with a first exemplary embodiment of the present invention.

The outline structure of a rotary encoder in the present invention is described referring to FIG. 1, a cross sectional side view. Operation shaft 1 is supported to be revolvable in bearing 2, operation shaft 1 holds at holding portion 1A, which is provided in the lower part, slider 11 made of a thin elastic metal sheet, and bearing 2 is engaged at the bottom part with case 5. The inner bottom surface of case 5 functions as contact-point board 13. Movable contact points 12A–12C of slider 11 are adopted to make contact with contact point pattern 14 disposed on contact-point board 13.

When operation shaft 1 is revolved, movable contact points 12A–12C of slider 11 make sliding motion on contact point pattern 14. As the result, rectangular wave signal is continuously outputted from terminals 8 connected with respective lead out sections of contact point pattern 14.

Bearing 2 is provided at the bottom with clicking spring 9 made of a thin elastic metal sheet, so that it is adopted to make contact with notches provided on the upper surface of holding portion 1A of operation shaft 1. Clicking spring 9 generates a clicking feeling in accordance with outputting of rectangular wave signal generated as the result of sliding motion of slider 11.

As described in the above, specific points of feature of the rotary encoder in the present embodiment are in the structure of contact points. The points of feature of the rotary encoder, which generates rectangular wave signal during one revolving motion, a 360° revolution, are described, hereinafter.

Figure 2:
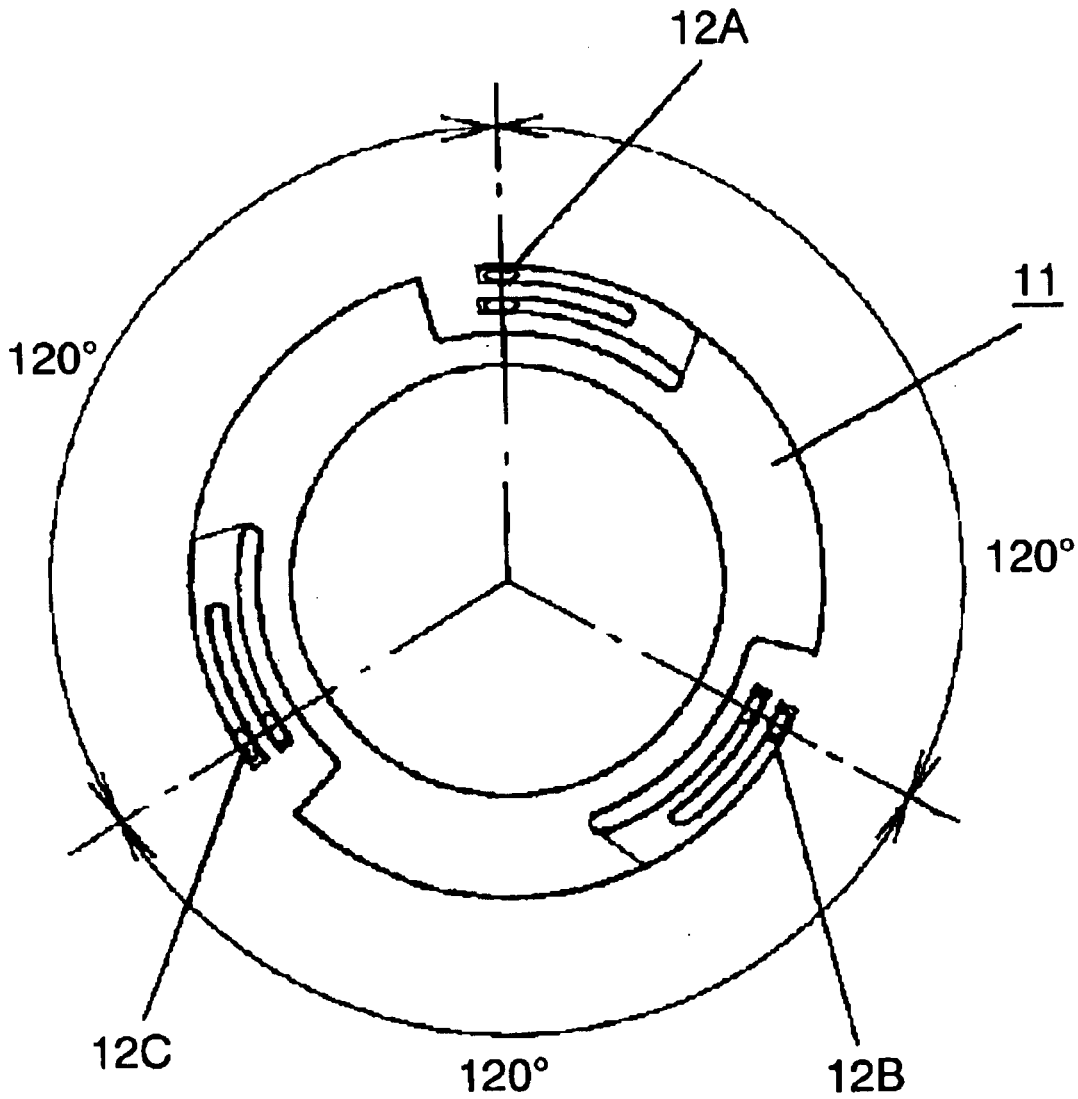
FIG. 2 is a plan view of a slider, which being the key portion of the rotary encoder in accordance with the first exemplary embodiment of the present invention.
Figure 3:
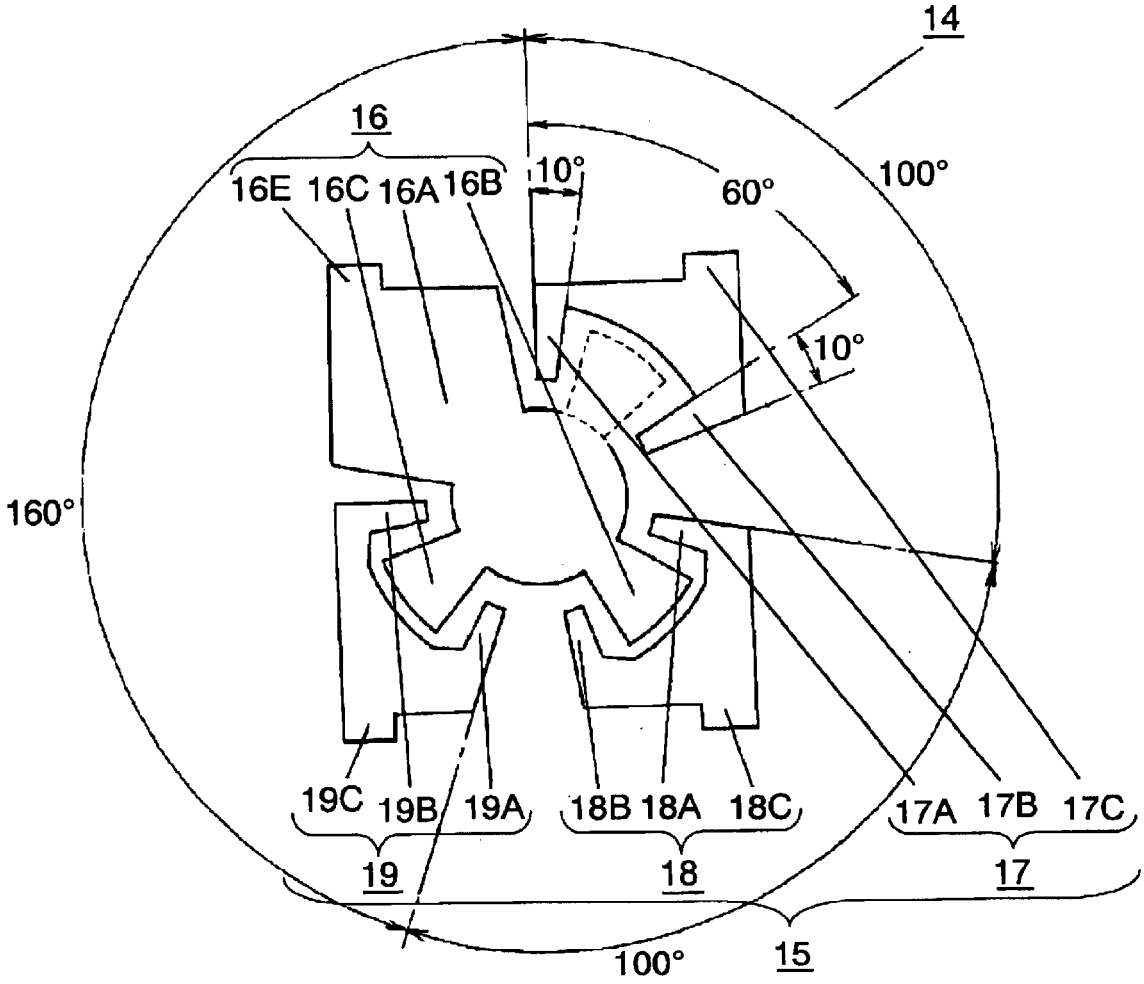
FIG. 3 is a conceptual drawing of a contact point pattern on a contact-point board, which pattern being the key portion of the rotary encoder in accordance with the first exemplary embodiment of the present invention.

The rotary encoder in the present embodiment is an 18-signal type, which generates three-phase rectangular wave signal at a 20° pitch, or 18 signals continuously for a 360° revolution. FIG. 2 shows a plan view of the slider in the rotary encoder in the present embodiment. FIG. 3 is a conceptual drawing of the contact point pattern disposed on the contact-point board.

As shown in FIG. 2, slider 11 is provided with three movable contact points 12A, 12B and 12C disposed along a circle of a certain radius from the revolution center. Movable contact points 12A, 12B and 12C are disposed at an interval of 120°, and are adopted to make contact with the upper surface of contact-point board 13, as illustrated in FIG. 1. The interval of movable contact points 12A, 12B, 12C is 6 times as large as the output pitch 20° of rectangular wave signal. Movable contact points 12A–12C may have one contact tip each; however, in order to ensure a stable contact, it is preferred that each has two contact tips as illustrated in FIG. 2. Of course each may have three or more contact tips.

On the surface of contact-point board 13, contact point pattern 14 is provided, which pattern consisting of signal pattern 15 and common pattern 16, as shown in FIG. 3. Signal pattern 15 consisting of fixed contact points 17, 18 and 19 is disposed along a circle having the same radius as movable contact points 12A–12C. Fixed contact point 17 is formed of two conductive layers 17A, 17B of the same angular width 10° disposed in a radial arrangement, which share a common lead out section 17C. Conductive layers 17A, 17B are disposed at an angular pitch 60°, which angle being three times as large as the output pitch 20° of rectangular wave signal. Fixed contact points 18 and 19 are also provided in the same configuration; having a lead out section 18C and a lead out section 19C, and two conductive layers 18A, 18B and conductive layers 19A, 19B, respectively.

Angular pitch of fixed contact points 17 and 19 is 160°, which angle being larger than angular interval 120° of movable contact points 12A–12C of slider 11 by twice the output pitch 20° of rectangular wave signal. Respective angular pitches of fixed contact points 17, 18 and 18, 19 are 100°, which angle being smaller than angular interval 120° of movable contact points 12A–12C of slider 11 by the output pitch 20° of rectangular wave signal. Either of the pitches is larger than one angular width 70° of fixed contact points 17–19.

In the spaces between fixed contact points 17 and 19, between conductive layers 18A and 18B, and between conductive layers 19A and 19B, fan-shape conductive layers 16A, 16B and 16C of common pattern 16 are disposed, respectively. Conductive layers 16A, 16B and 16C are disposed on contact-point board 13 along a circle of the same radius as movable contact points 12A–12C at such regions where signal pattern 15 in not disposed. Conductive layers 16A, 16B and 16C are connected with lead out section 16E, and disposed insulated from signal pattern 15. Conductive layers 16A, 16B and 16C are disposed at such locations of angular arrangement; where, while one of movable contact points 12A–12C is having contact with any one of conductive layers 17A, 17B, 18A, 18B, 19A and 19B, at least one other movable contact point among 12A–12C makes contact with the conductive layer 16A, 16B, 16C. Namely, the location formed between conductive layers 17A and 17B, as shown in FIG. 3 with dotted lines, does not need to have it.

All of the conductive layers, lead out sections and portions connecting the conductive layers with lead out sections, viz. those constituting contact point pattern 14, should preferably be provided by punching a thin metal sheet; and integrating them with resin case 5 by insert molding. Thereby, they can be provided at high precision in terms of relative positioning.

Various states of coupling between contact point pattern 14 of contact-point board 13 and movable contact points 12A–12C of slider 11 are described referring to FIG. 4 through FIG. 9, hereinafter.

Figure 4:
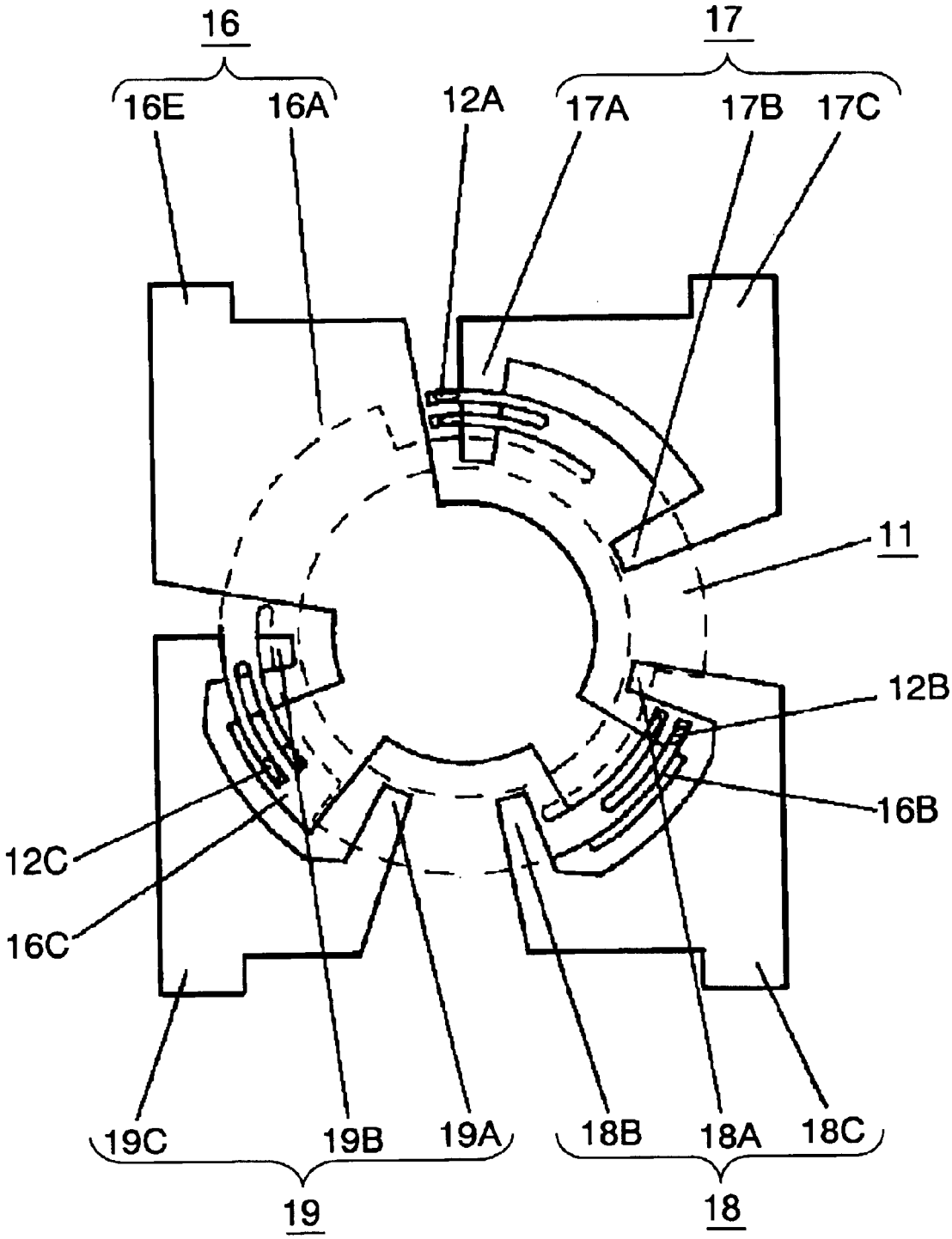
FIG. 4–FIG. 9 are conceptual drawings that describe couplings between the contact point pattern of the contact-pattern board and the movable contact points of the slider, in the rotary encoder in accordance with the first exemplary embodiment of the present invention.

As shown in FIG. 4, in the normal state before revolving operation shaft 1, clicking spring 9 is in engagement with a notch provided on the upper surface of holding portion 1A. Slider 11 is having conductive contact with common pattern 16. However, slider 11 is having no contact with any one of fixed contact points 17–19. Namely, it is standing still at open state. Namely, in the state as illustrated in FIG. 4, only movable contact point 12C is staying on conductive layer 16C to make contact, but the remaining movable contact points 12A, 12B are at places where there are no signal pattern 15. In the above-described normal state, or open state, lead out section 16E of common pattern 16 has no electrical conduction with any one of lead out sections 17C, 18C and 19C of signal pattern 15.

Starting from the above-described open state, operation shaft 1 is revolved to provide slider 11 with clockwise sliding motion along contact point pattern 14. Concept of the shifting state of contacts is shown in FIG. 5 through FIG. 9.

Figure 5:
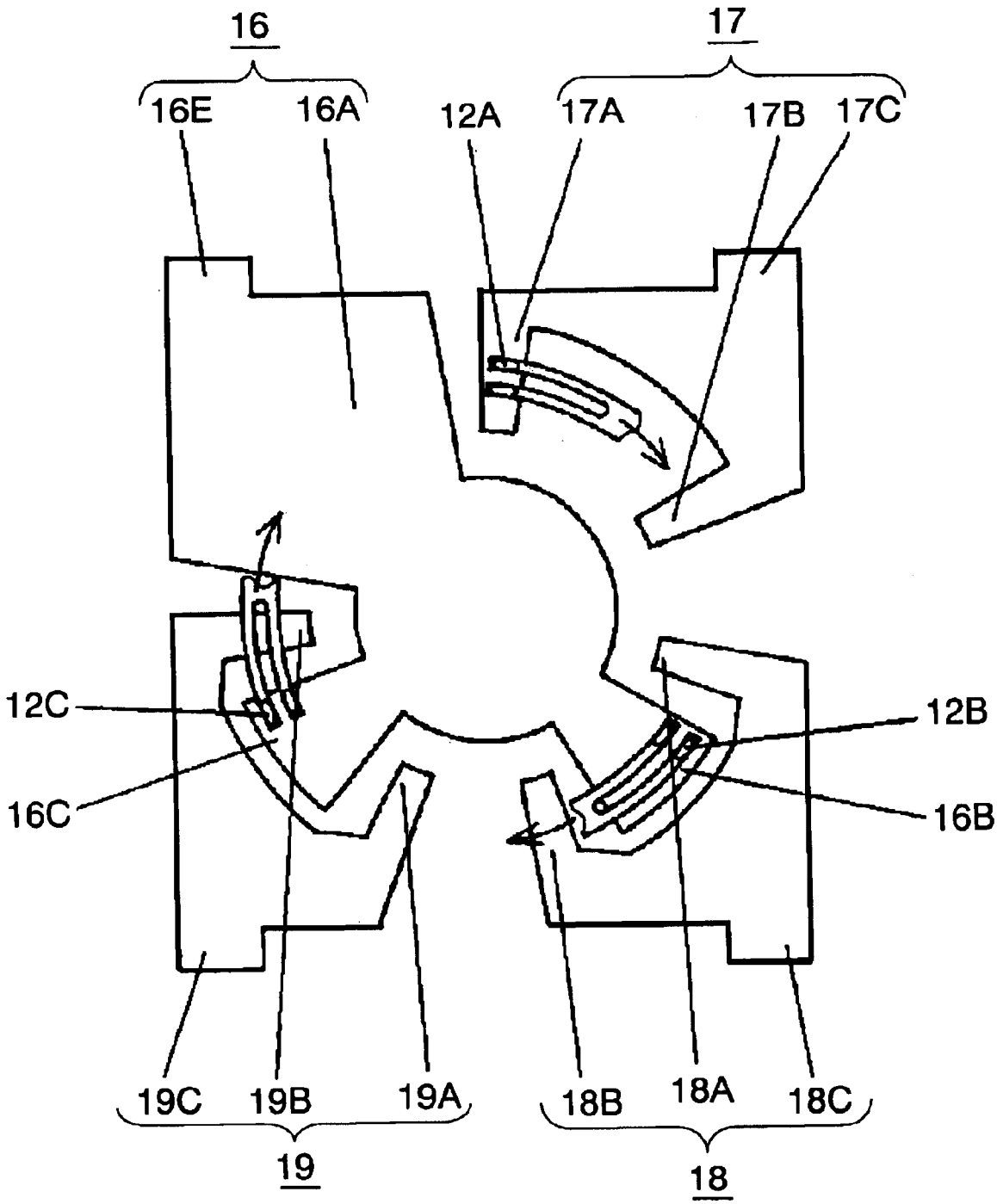

FIG. 5 shows a state where slider 11 is revolved clockwise and staying somewhere in an angular range between approximately 5° and approximately 10°. Movable contact point 12A is making contact with conductive layer 17A, at the same time movable contact points 12B, 12C are having contact with conductive layers 16B, 16C, respectively. Thus, lead out section 16E and lead out section 17C are in electrical conduction to each other.

Figure 6:
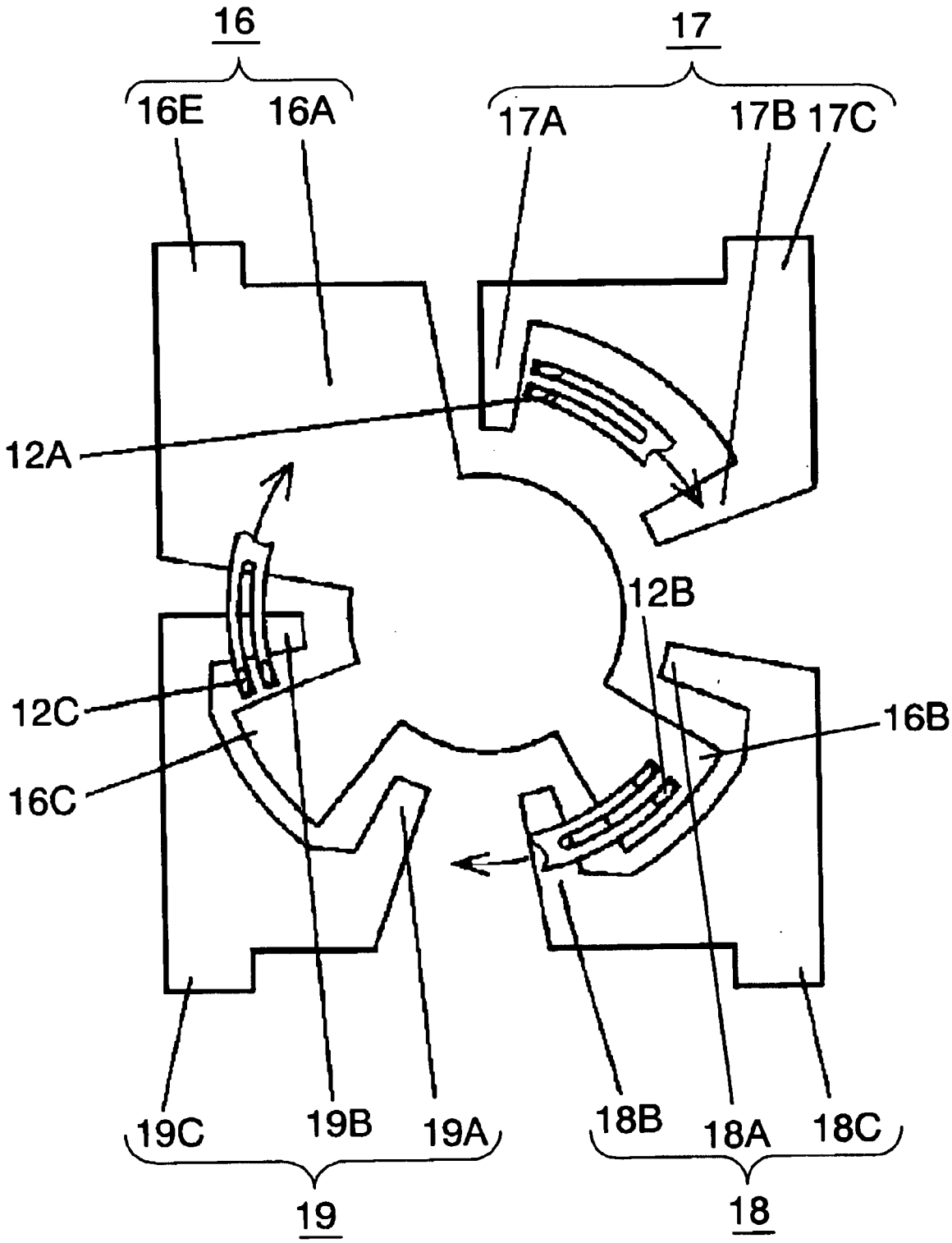

When slider 11 is revolved further clockwise, movable contact point 12A leaves from conductive layer 17A, as shown in FIG. 6. Namely, movable contact points 12A–12C are again put into open state for approximately 10° angular range. Namely, these movable contact points have no contact with any one of fixed contact points 17–19 of signal pattern 15. Thus, lead out section 16E has no conduction with any one of lead out sections 17C–19C.

Figure 7:
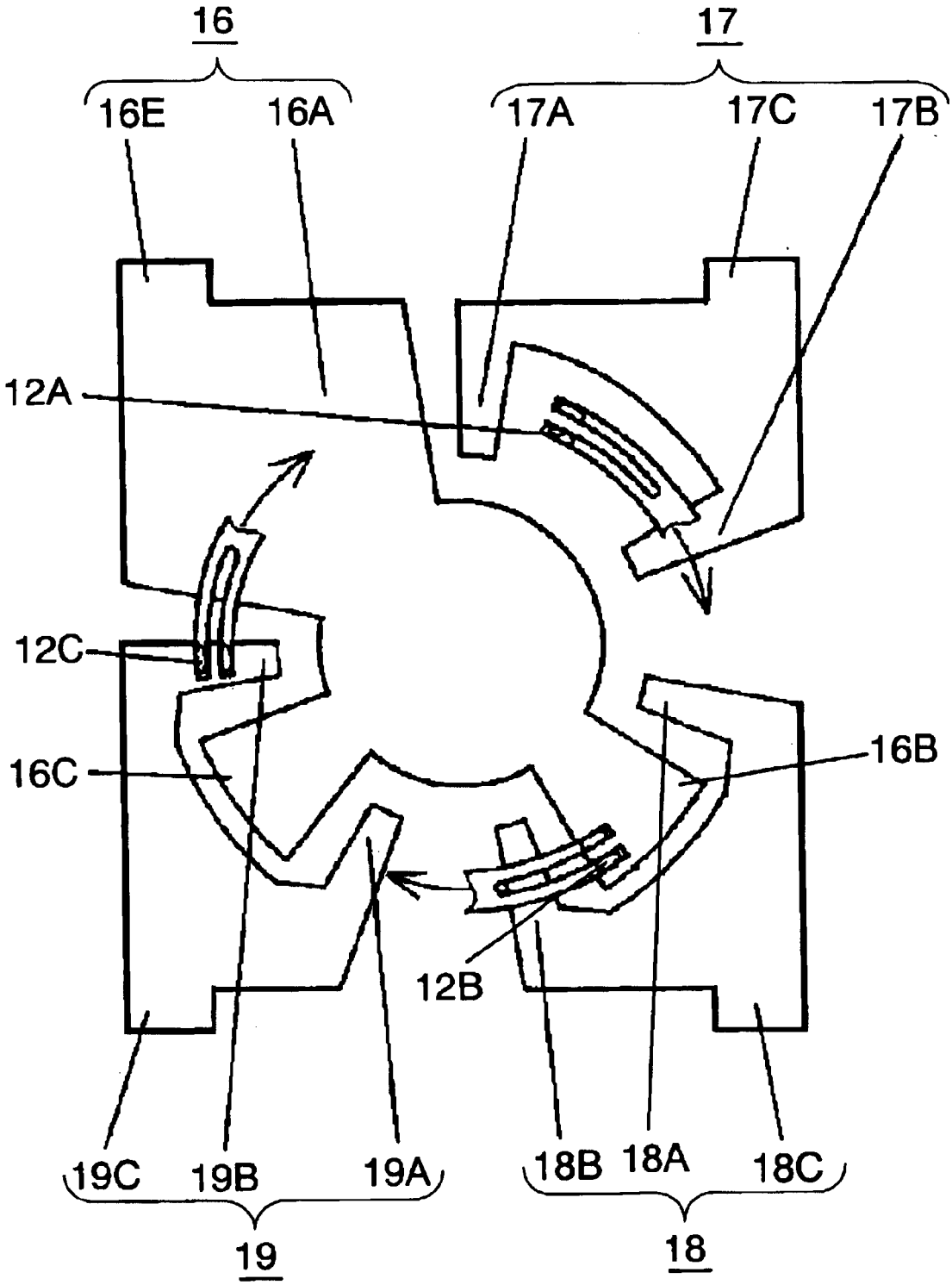

When slider 11 is revolved further, movable contact point 12C comes into contact with conductive layer 19B for approximately 10° angular range, ref FIG. 7. Movable contact point 12B also comes into contact with conductive layer 16B. Lead out section 16E and lead out section 19C are put into conduction state to each other.

Figure 8:
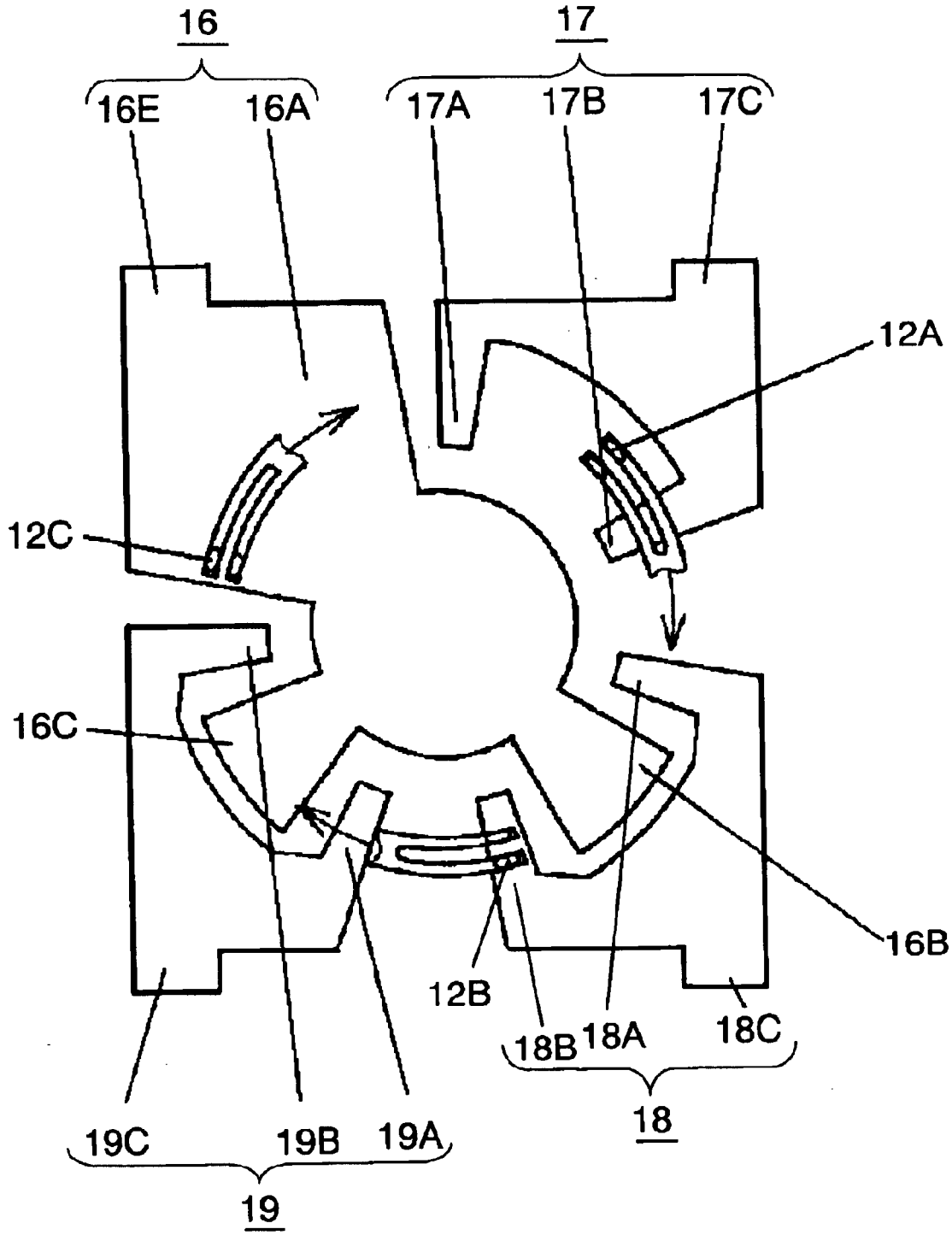

When slider 11 is revolved further, movable contact point 12B comes into contact with conductive layer 18B as shown in FIG. 8, after having an open state of approximately 10° angular range. Lead out section 16E and lead out section 18C are put into conduction state to each other.

Figure 9:
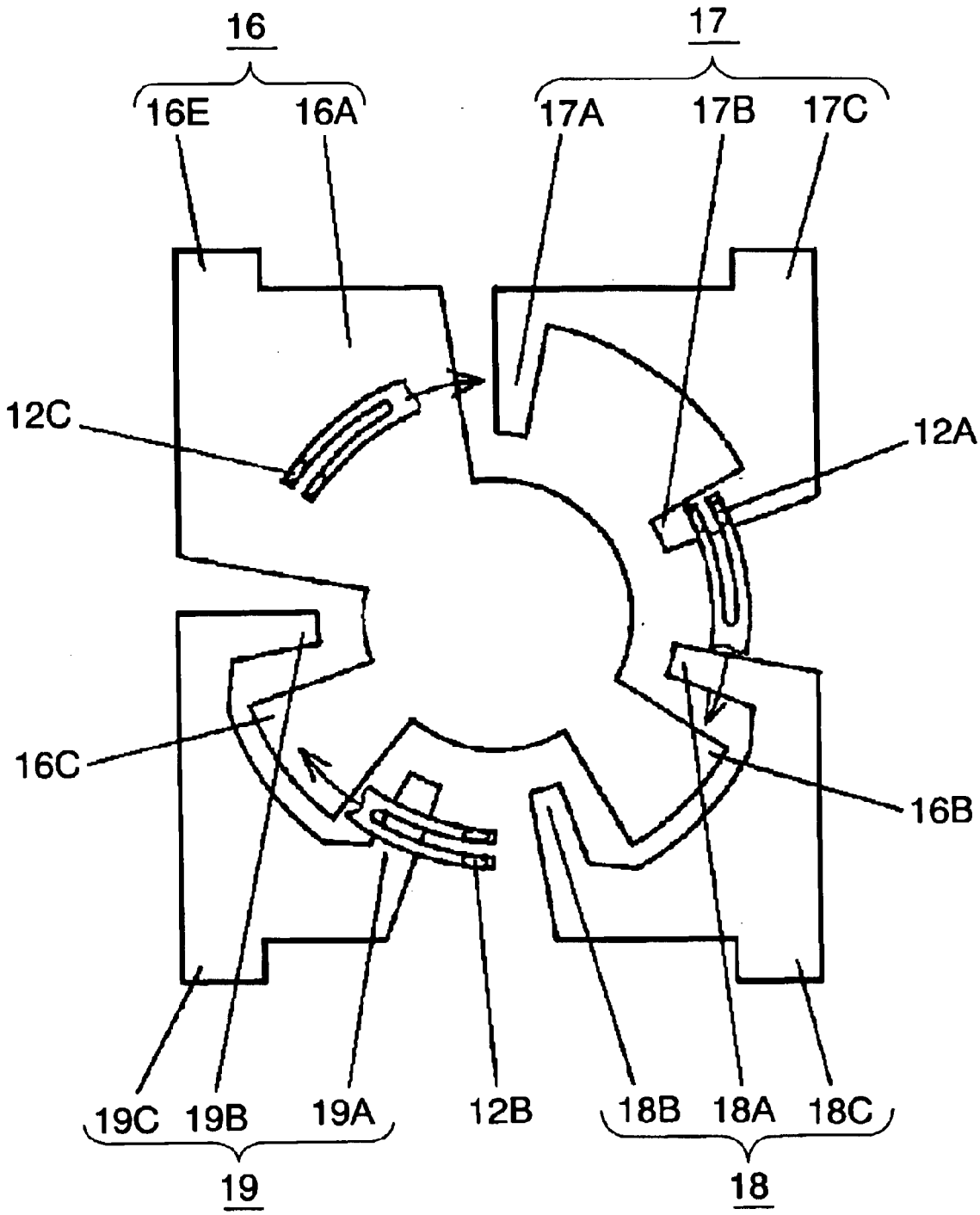

When slider 11 is revolved further, movable contact point 12A comes into contact with conductive layer 17B, as shown in FIG. 9, after having an open state of approximately 10° angular range. Lead out section 16E and lead out section 17C are again put into conduction state to each other.

When slider 11 is further revolved, lead out section 16E and lead out section 19C are put into conduction state, and after that lead out section 16E and lead out section 18C are put into conduction state to each other.

As described in the above, the clockwise sliding motion of slider 11 brings lead out section 16E of common pattern 16 into conduction state with respective lead out sections 17C, 19C and 18C of fixed contact points 17, 19 and 18 of signal pattern 15, one after the other in the order. The conduction state is repeated cyclically at 20° angular pitch, with an open state of 10° angular range in between.

Figure 10:
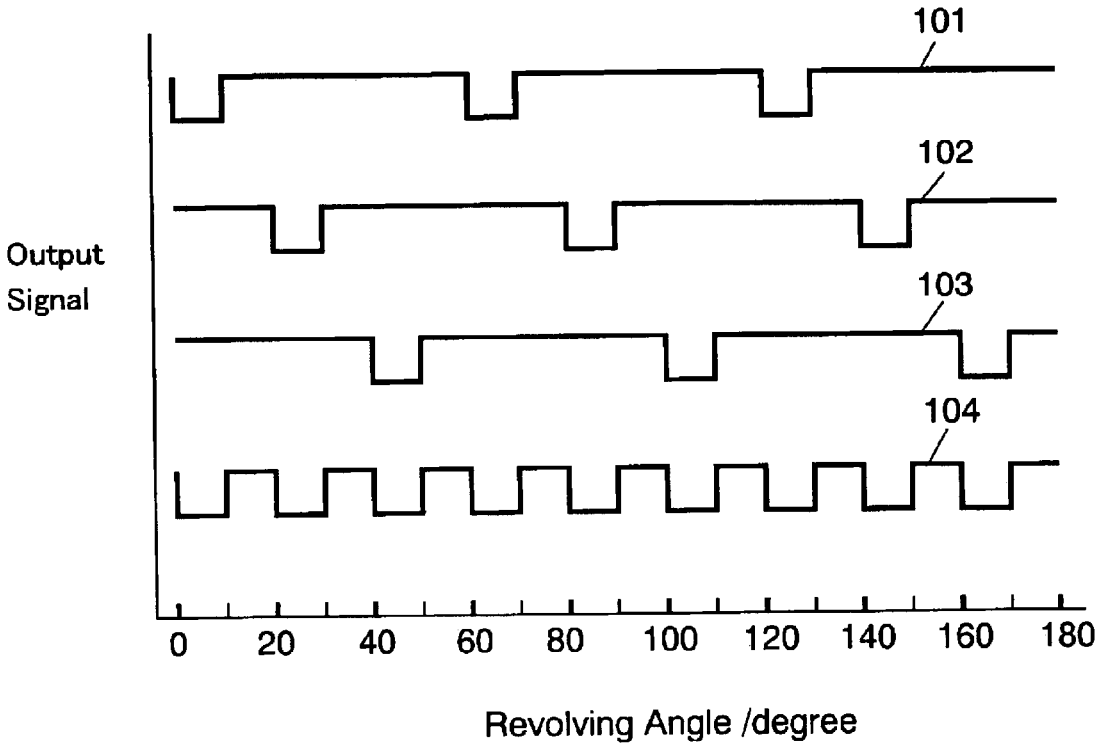
FIG. 10 is a waveform chart of a three-phase rectangular wave signal generated by the rotary encoder in accordance with the first exemplary embodiment of the present invention.

FIG. 10 is a waveform chart of three-phase rectangular wave signal; where, first phase output 101 represents output signal from lead out section 17C, second phase output 102 represents output signal from lead out section 19C and third phase output 103 represents output signal from lead out section 18C. Overall output 104 of the rotary encoder, which is an integration of the three-phase rectangular signals, exhibits rectangular waveform of 20° angular pitch. Output 104 is delivered continuously via terminals 8 connected with respective lead out sections 16E, 17C, 19C and 18C.

The three-phase rectangular wave signal is generated likewise, even when operation shaft 1 is revolved in the reverse revolving direction, viz. when it is revolved anti-clockwise.

As described above, in the rotary encoder of the present embodiment, a plurality of slider 11's movable contact points 12A–12C disposed on a certain circle of specific radius are driven by revolution of operation shaft 1 to make a sliding motion on contact point pattern 14, which is disposed in a circular arrangement on contact-point board 13. Thus, the rotary encoder can be implemented in a compact shape of small outer diameter.

By providing signal pattern 15 in the above-described arrangement, a three-phase rectangular wave signal can be generated continuously between three fixed contact points 17–19 of signal pattern 15 and common pattern 16 at a 20° pitch. The rectangular wave signal is outputted between lead out sections 17C–19C and lead out section 16E.

Width of each of conductive layers of fixed contact points 17–19 is smaller than ⅓ of 60°, which angle 60° being the angular pitch between the two conductive layers 17A and 17B, the two conductive layers 18A and 18B, and the two conductive layers 19A and 19B in respective fixed contact points 17–19. As the result, a first phase, a second phase and a third phase rectangular wave signals can be outputted as independent signals. When the rotary encoder is used in an electronic apparatus, microcomputer-related circuits can be structured simply and the signal processing becomes easy; furthermore, power consumption for the signal processing can be made smaller.

Figure 11:
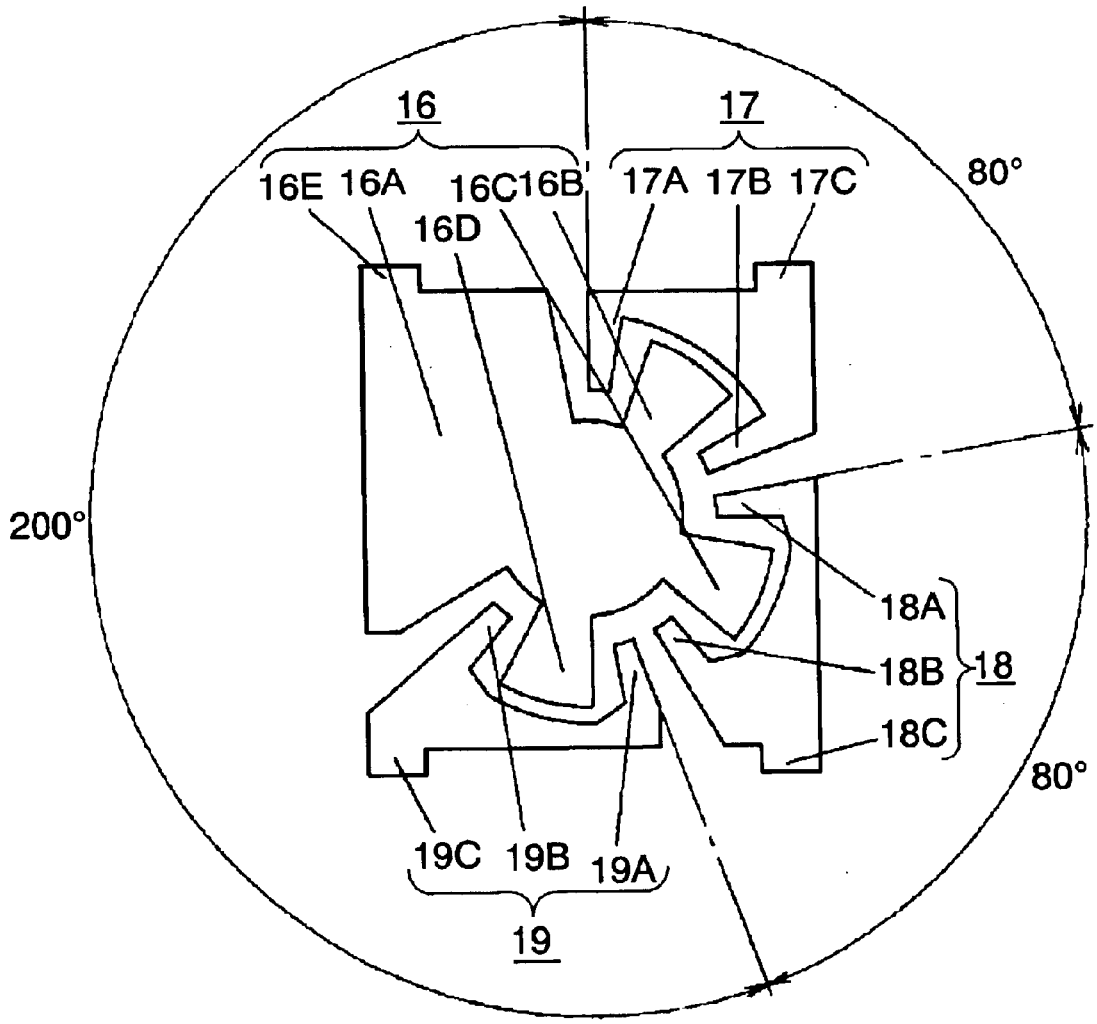
FIG. 11 is a conceptual drawing of another contact point pattern on the contact-point board, which pattern being the key portion of the rotary encoder in accordance with the first exemplary embodiment of the present invention.
Figure 12:
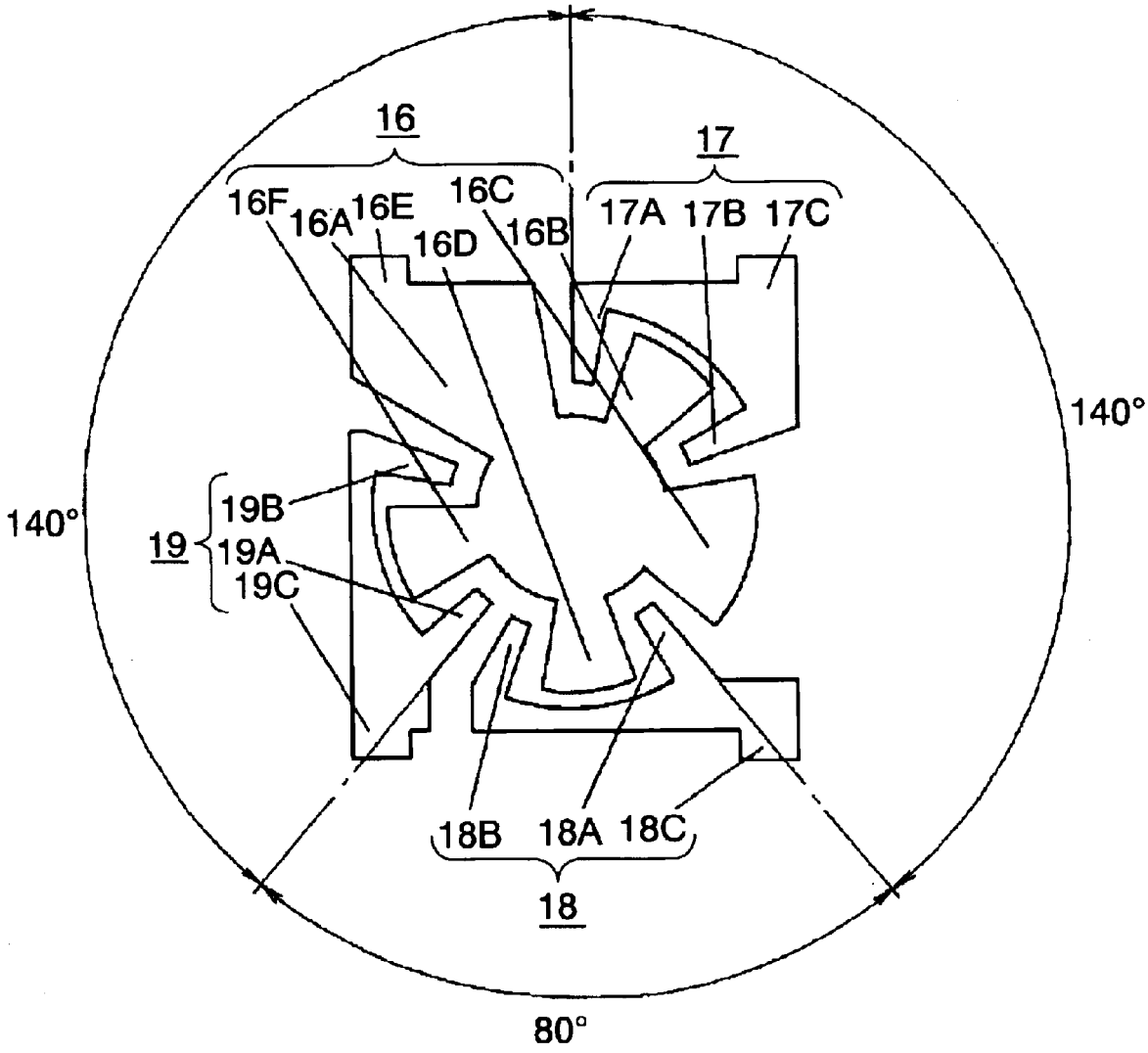
FIG. 12 is a conceptual drawing of a still other contact point pattern on the contact-point board, which pattern being the key portion of the rotary encoder in accordance with the first exemplary embodiment of the present invention.

In the above-described 18-signal type rotary encoder which generates three-phase rectangular wave signal at 20° pitch, such other signal patterns 15 having different angular pitch arrangement as illustrated in FIG. 11, FIG. 12 may be used instead on contact-point board 13. Fixed contact points 17, 18 and 19 of signal pattern 15 in the foregoing descriptions are disposed on the same sliding circle as movable contact points 12A–12C of slider 11, at angular pitches 160° for one place and 100° for two places, as illustrated in FIG. 3. Whereas in FIG. 11 and FIG. 12, each of the angular pitches of fixed contact points 17, 18 and 19 is one of 80°, 140° and 200°. The angular pitches in the above configuration are smaller, or larger, than the angular interval 120° between movable contact points 12A, 12B, 12C, or a multiple of it, by output pitch 20° of rectangular wave signal, or its double, 40°. Any one of the above angular pitches is larger than the one angular width 70° of fixed contact points 17, 18 and 19. The sum of the three angular pitches makes 360°.

Also in these pattern arrangements, conductive layers 16A, 16B, 16C, 16D and 16F of common pattern 16 are disposed in the places where none of conductive layers 17A–19B of fixed contact points 17–19 is disposed. Namely, they are disposed in places formed between the two conductive layers 17A and 17B of fixed contact point 17, between the two conductive layers 18A and 18B of fixed contact point 18, or between the two conductive layers 19A and 19B of fixed contact point 19, or places between fixed contact points 17–19 at a certain specific angular position. These conductive layers are connected with common lead out section 16E. These structures also implement compact rotary encoders that generate the same output.

(Embodiment 2)

The basic structure of a rotary encoder in accordance with a second exemplary embodiment of the present invention remains the same as that of the embodiment 1 shown in FIG. 1. In the rotary encoder in the present embodiment has slider 21 in place of slider 11, contact-point board 23 in place of contact-point board 13, contact point pattern 24 in place of contact point pattern 14, and movable contact points 22A–22E in place of movable contact points 12A–12C. Descriptions relevant to FIG. 1 are identical to those made earlier in embodiment 1; so, they are eliminated here.

The rotary encoder in embodiment 2 is a 30-signal type that outputs three-phase rectangular wave signal at 12° pitch or 30 signals per 360° continuously.

Figure 13:
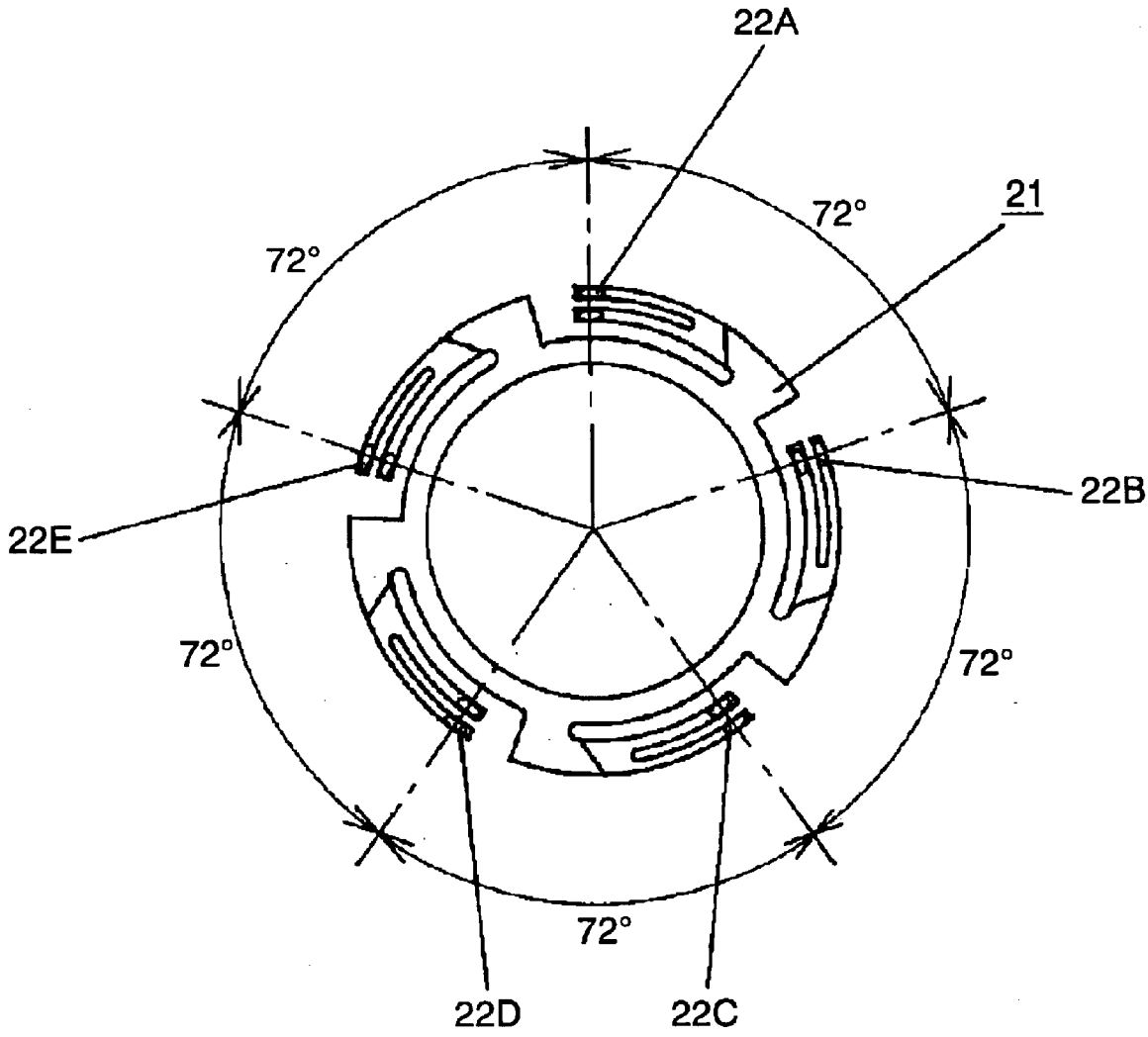
FIG. 13 is a plan view of a slider, which being the key portion of a rotary encoder in a second exemplary embodiment of the present invention.
Figure 14:
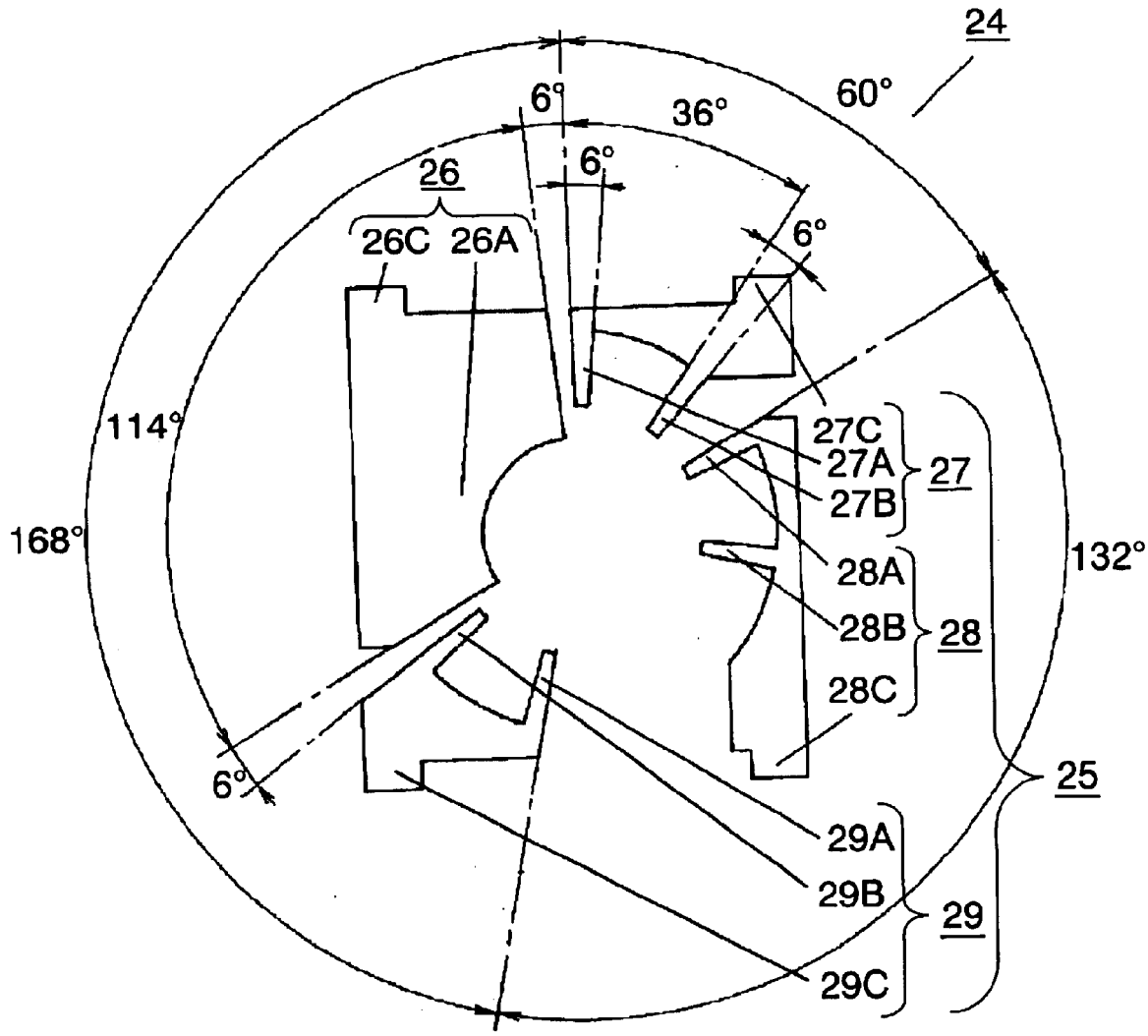
FIG. 14 is a conceptual drawing of a contact point pattern on a contact-point board, which being the key portion of the rotary encoder in the second exemplary embodiment of the present invention.

FIG. 13 shows a plan view of a slider used in the rotary encoder in accordance with the present embodiment. FIG. 14 is a conceptual drawing of contact point pattern on the contact-point board.

As shown in FIG. 13, slider 21 is provided with five elastic movable contact points 22A–22E at an interval of 72° on a circle at a certain radius from the revolution center. The interval of movable contact points 22A–22E is 6 times as large as the output pitch 12° of rectangular wave signal. Each of movable contact points 22A–22E is adopted to make contact with the upper surface of contact-point board 23.

As to the number of contact tips at each of movable contact points 22A–22E, it remains the same as in embodiment 1. As shown in FIG. 14, contact-point board 23 is provided on the surface with contact point pattern 24 consisting of signal pattern 25 and common pattern 26, in the same way as in embodiment 1. Namely, signal pattern 25 consisting of fixed contact points 27, 28 and 29 is disposed on a circle of the same radius as movable contact points 22A–22E. Fixed contact point 27 is formed of two conductive layers 27A and 27B of the same angular width 6° disposed in a radial arrangement, which share common lead out section 27C. Conductive layers 27A, 27B are disposed at an angular pitch 36°, which angle being three times as large as the output pitch 12° of rectangular wave signal. Fixed contact points 28 and 29 are also formed to the identical structure; having a lead out section 28C and a lead out section 29C, and two conductive layers 28A, 28B conductive layers 29A, 29B, respectively.

Angular pitch of fixed contact points 27 and 28 is 60°, which pitch being smaller than angular interval 72° of movable contact points 22A–22E of slider 21 by output pitch 12° of rectangular wave signal. Angular pitch of fixed contact points 28 and 29 is 132°, which pitch being smaller than twice the angular interval 72° of movable contact points 22A–22E of slider 21 by output pitch 12° of rectangular wave signal. Angular pitch of fixed contact points 29 and 27 is 168°, which pitch being larger than twice the angular interval 72° of movable contact points 22A–22E of slider 21 by twice the output pitch 12° of rectangular wave signal. Any one of the pitches is larger than one angular width 42° of fixed contact points 27–29.

In the space between fixed contact points 29 and 27, fan-shape conductive layer 26A of common pattern 26 is provided for an angular range 114°, which conductive layer having dedicated lead out section 26C and being insulated from signal pattern 25. Conductive layer 26A is disposed on contact-point board 23 along the sliding circle of the same radius as movable contact points 22A–22E of slider 21 in the region where signal pattern 25 isn't disposed.

Now in the following, various states of coupling between contact point pattern 24 of contact-point board 23 and movable contact points 22A–22E of slider 21 are described referring to FIG. 14 through FIG. 18.

Figure 15:
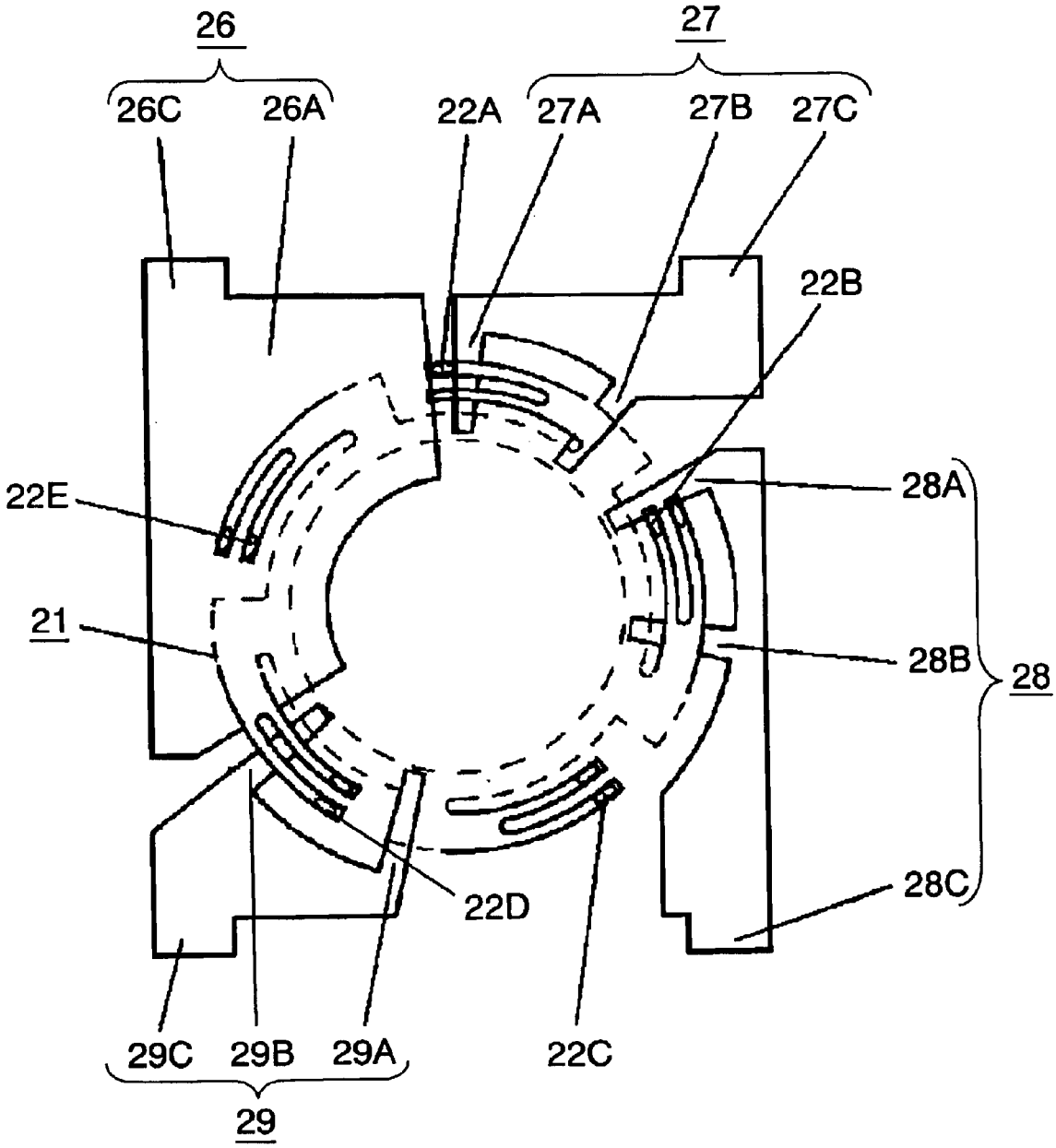
FIG. 15–FIG. 18 are conceptual drawings that describe couplings between the contact point pattern of the contact-point board and the movable contact points of the slider, in the rotary encoder in the second exemplary embodiment of the present invention.

As shown in FIG. 15, in the normal state where operation shaft 1 is not revolved, clicking spring 9 is in engaged with a notch provided on the upper surface of holding portion 1A, and slider 21 is having contact with common pattern 26. However, slider 21 is making no contact with any of fixed contact points 27–29, or it is standing still in open state. This state remains the same as in embodiment 1. Namely, only movable contact point 22E is staying on conductive layer 26A, but the remaining movable contact points 22A–22D are making no contact with any one of fixed contact points 27–29.

When operation shaft 1 is revolved, starting from the above-described open state, slider 21 makes clockwise sliding motion along contact point pattern 24. The shifting state of contact is shown in conceptual drawings, FIG. 16 through FIG. 18.

Figure 16:
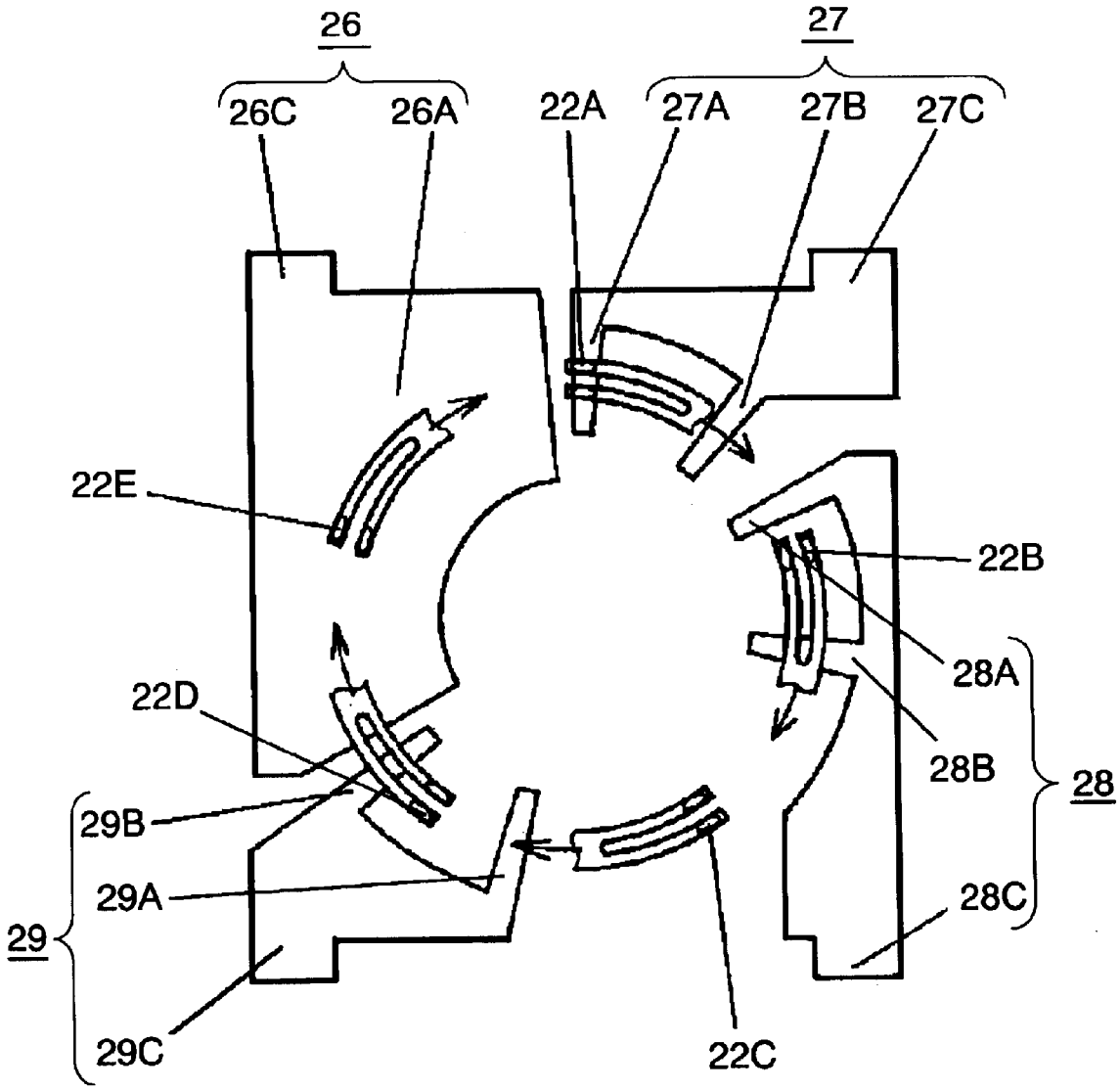

Starting from the state as shown in FIG. 15, when slider 21 is revolved clockwise, it shifts to FIG. 16. Namely, after slider 21 is revolved clockwise for approximately 3°, movable contact point 22A makes contact with conductive layer 27A by an approximate angular range 6°. During the moment, movable contact point 22E is having contact with conductive layer 26A, and lead out section 26C and lead out section 27C are in conduction state to each other.

Figure 17:
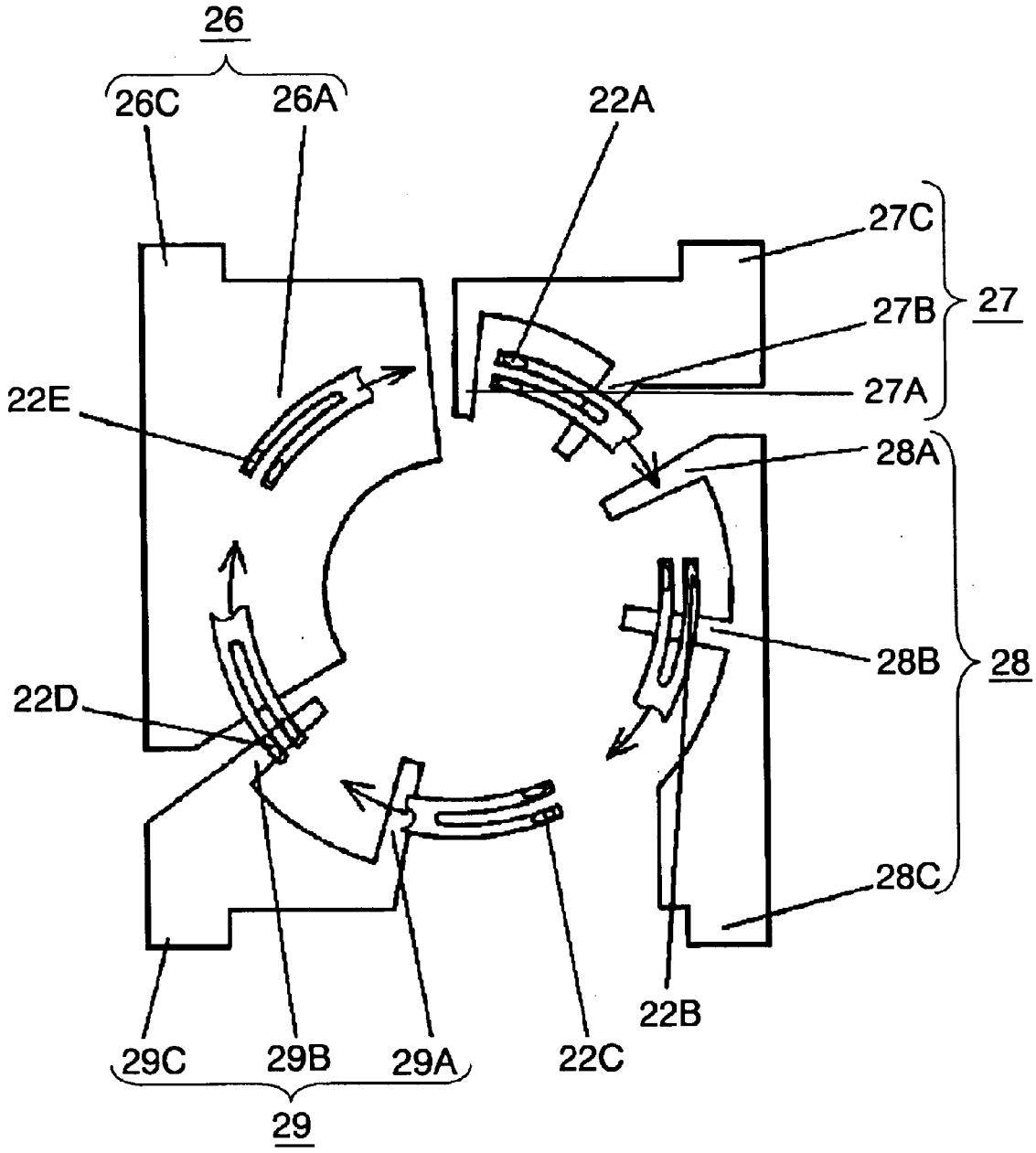

When slider 21 is revolved further, movable contact point 22D gets in contact with conductive layer 29B of fixed contact point 29, as shown in FIG. 17, after having an open state for approximately 6° angular range. During the moment, movable contact points 22E is keeping contact with conductive layer 26A. Thus, lead out section 26C and lead out section 29C are in conduction state to each other.

Figure 18:
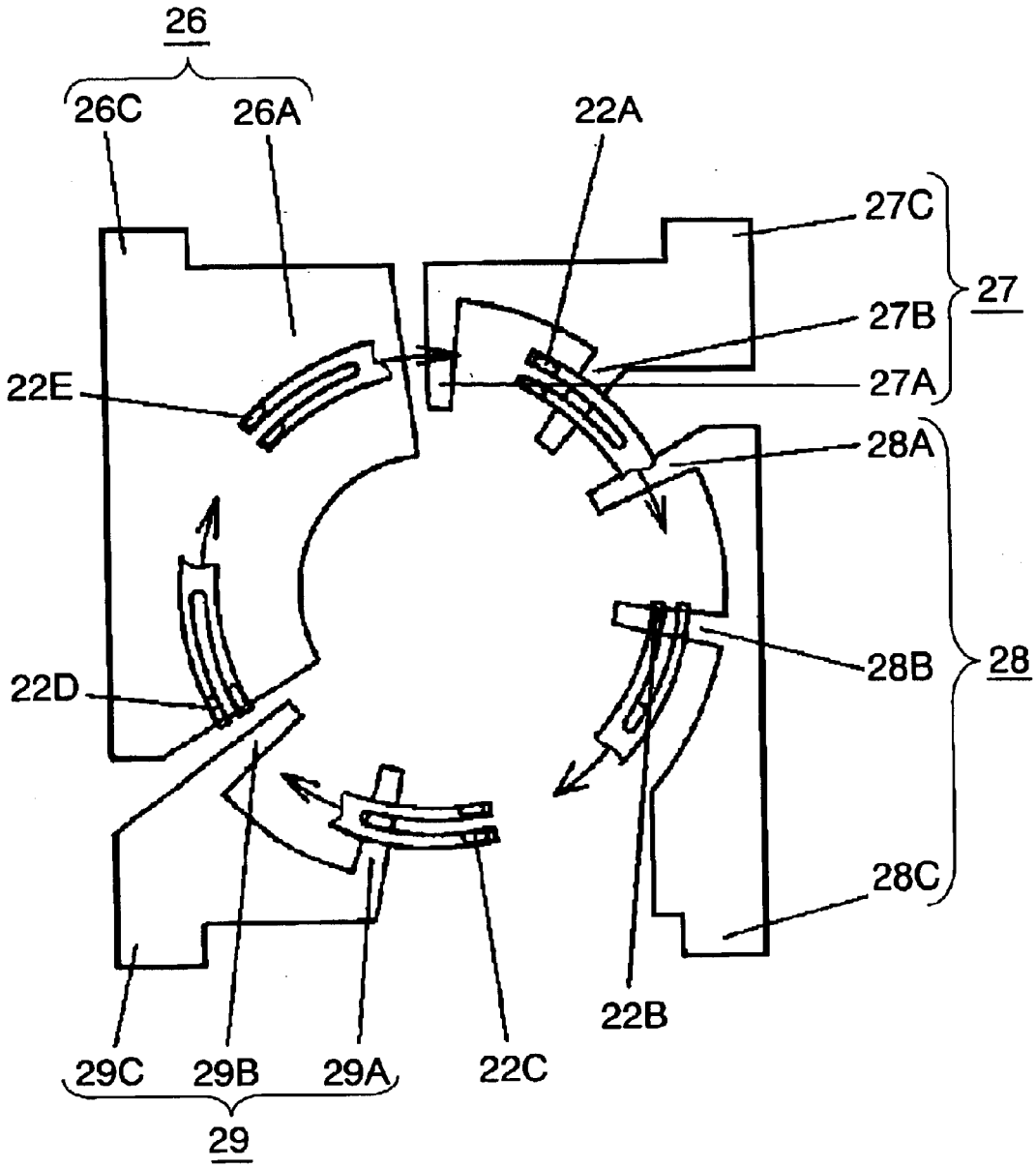

When slider 21 is revolved further, movable contact point 22B gets in contact with conductive layer 28B of fixed contact point 28, as shown in FIG. 18, after having an open state for approximately 6° angular range. Also during the moment, movable contact point 22E is keeping contact with conductive layer 26A. Thus, lead out section 26C and lead out section 28C are in conduction state to each other.

As described above, the clockwise revolution of slider 21 brings respective lead out sections 27C, 29C and 28C into conduction state with lead out section 26C one after the other in the order, for an angular pitch of 12° with an open state of angular range 6° in between. The cycle repeats.

Figure 19:
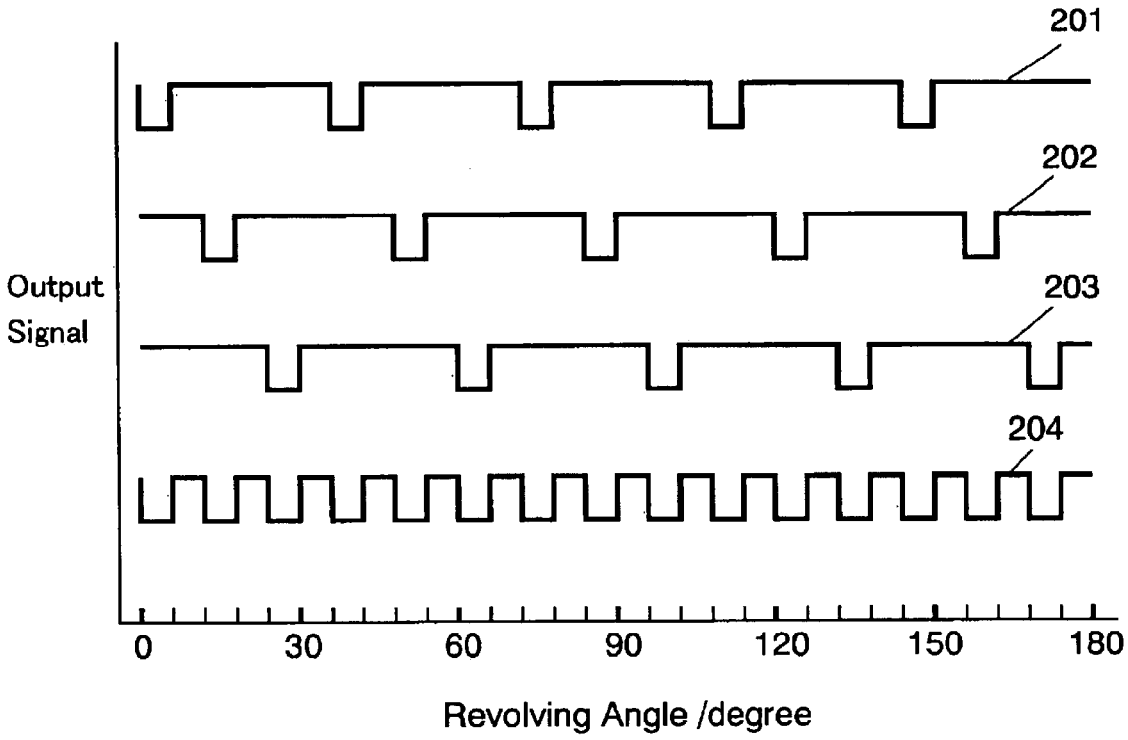
FIG. 19 is a waveform chart of a three-phase rectangular wave signal generated by the rotary encoder in the second exemplary embodiment of the present invention.

FIG. 19 is a waveform chart of three-phase rectangular wave signal, where first phase output 201 represents output signal from lead out section 27C, second phase output 202 represents output signal from lead out section 29C and third phase output 203 represents output signal from lead out section 28C. Overall output 204 of the rotary encoder, which is an integration of the three-phase rectangular signals, exhibits a rectangular wave of 12° pitch. Output 204 is delivered continuously via terminal 8 connected with respective lead out sections 26C, 27C, 29C and 28C. The three-phase rectangular wave signal is generated likewise even when operation shaft 1 is revolved in the reverse revolving direction, viz. when slider 21 is revolved anti-clockwise.

As described above, in the rotary encoder of the present embodiment, a plurality of slider 21's movable contact points 22A–22E disposed on a certain circle of specific radius are driven by revolution of operation shaft 1 to make a sliding motion on contact point pattern 24, which is disposed in a circular arrangement on contact-point board 23. Thus, the rotary encoder can be implemented in a compact shape of small outer diameter.

By providing signal pattern 25 in the above-described arrangement, a three-phase rectangular wave signal can be generated continuously between three fixed contact points 27–29 of signal pattern 25 and common pattern 26 at a 12° pitch. The rectangular wave signal is outputted between lead out sections 27C–29C and lead out section 26E.

Also in the rotary encoder in the present embodiment, the first phase, the second phase and the third phase rectangular wave signals can be outputted as independent signals, like in embodiment 1. When the rotary encoder is used in an electronic apparatus, microcomputer-related circuits can be structured simply and the signal processing becomes easy; furthermore, power consumption for the signal processing can be made smaller.

Figure 20:
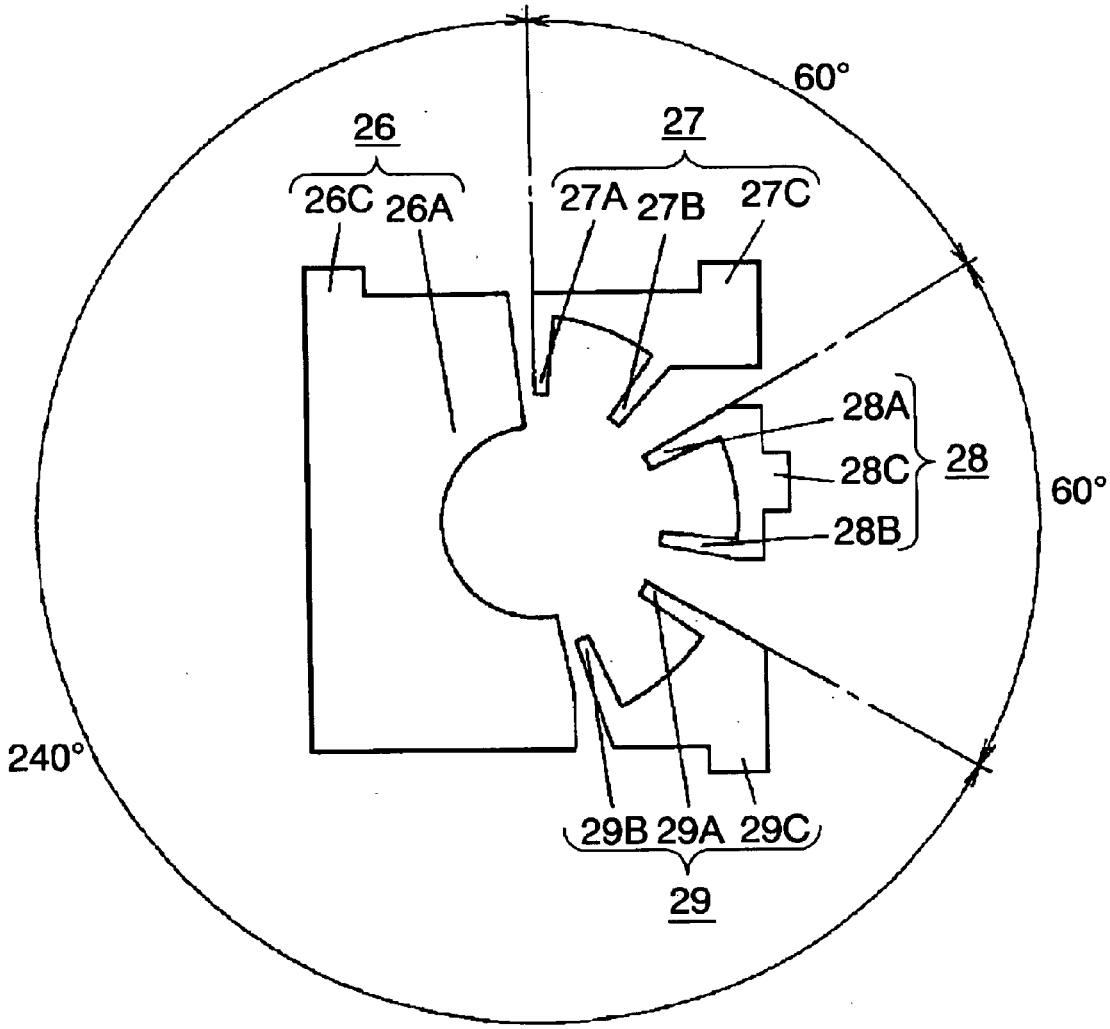
FIG. 20 is a conceptual drawing of another contact point pattern on the contact-point board, which being the key portion of the rotary encoder in the second exemplary embodiment of the present invention.
Figure 21:
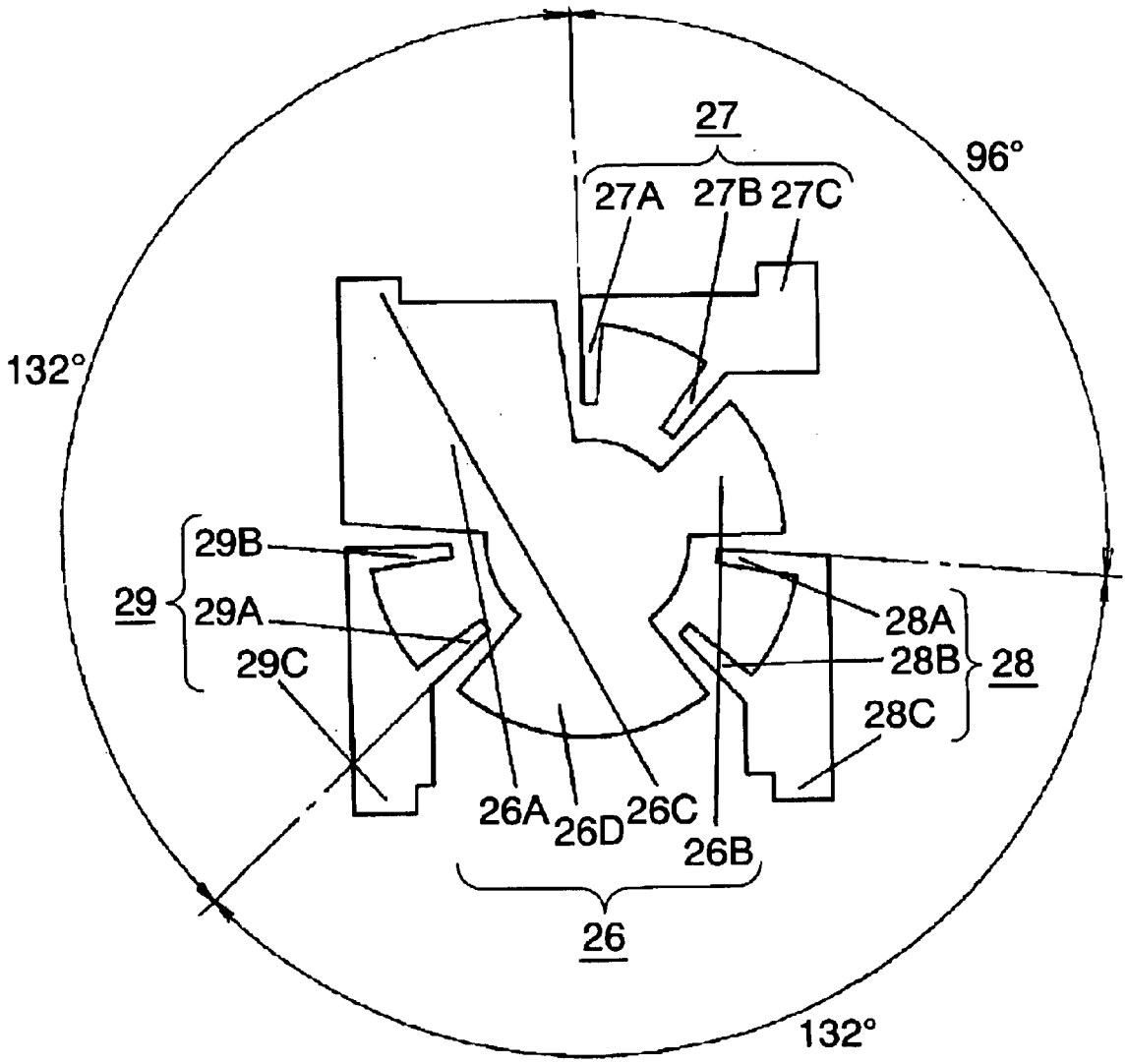
FIG. 21 is a conceptual drawing of a still other contact point pattern on the contact-point board, which being the key portion of the rotary encoder in the second exemplary embodiment of the present invention.

In the above-described 30-signal type rotary encoder which generates three-phase rectangular wave signal at 12° pitch, such other signal patterns 25 having different angular pitch arrangement as illustrated in FIG. 20, FIG. 21 may be used instead on contact-point board 23. Fixed contact points 27, 28 and 29 of signal pattern 25 in the foregoing descriptions are disposed on the same sliding circle as movable contact points 22A–22E of slider 21, at angular pitches 60°, 132° and 168°, as illustrated in FIG. 14. Whereas in FIG. 20 and FIG. 21, each of the angular pitches of fixed contact points 27–29 is one of 60°, 240°, 96° and 132°. The angular pitches in the above configuration are smaller, or larger, than the angular interval 72° between movable contact points 22A–22C, or a multiple of it, by output pitch 12° of rectangular wave signal, or its double, 24°. Any one of the above angular pitches is larger than the one angular width 42° of fixed contact points 27–29. The sum of the three angular pitches makes 360°.

Also in these pattern arrangements, conductive layers 26A, 26B and 26D of common pattern 26 are disposed in the places where none of conductive layers 27A–29B of fixed contact points 27–29 is disposed. Namely, they are disposed in places formed between fixed contact points 27–29, between the two conductive layers 27A and 27B of fixed contact point 27, between the two conductive layers 28A and 28B of fixed contact point 28, or between the two conductive layers 29A and 29B of fixed contact point 29, at a certain specific angular position. These conductive layers are connected with common lead out section 26C. These structures also implement compact rotary encoders that generate the same output.

In the above exemplary embodiments 1 and 2, descriptions have been made on rotary encoders which generate three-phase rectangular wave signals for 18 signals per 360°, and 30 signals per 360°. Other types of rotary encoders generating 36 signals, 45 signals, etc. can also be implemented through the same concept.

What is claimed is:

1. A rotary encoder outputting rectangular wave signals comprising a contact-point board having a conductive signal pattern and a common pattern; and a slider supported to be revolvable with respect to said contact-point board, which slider having a plurality of movable contact points disposed on a circle of a certain radius from a revolution center at an angular interval six times as large as an output pitch of the rectangular wave signal; wherein said signal pattern consists of three fixed contact points, each having two conductive layers of radial shape with the same width, electrically connected to each other, disposed along sliding circle of said movable contact points at an angular pitch three times as large as the output pitch of the rectangular wave signal;

angular pitch of said three fixed contact points is different from one of angular interval of said movable contact points, and a multiple of the angular interval of said movable contact points, by one of the output pitch of the rectangular wave signal, and twice of the output pitch of the rectangular wave signal, and larger than any one angular width of said three fixed contact points; and said common pattern is disposed insulated from said signal pattern on said contact-point board along sliding circle of said movable contact points, so that, at the time when either one of said movable contact points of said slider is having contact with either one of said three fixed contact points, it makes contact with remaining one of said movable contact points.

2. The rotary encoder of claim 1, wherein revolution of said slider generates three-phase rectangular wave signal continuously between said three fixed contact points and said common pattern at an equal pitch.

3. The rotary encoder of claim 1, wherein angular width of said conductive layer of radial shape is less than ⅓ of angular pitch of said two conductive layers of radial shape having electrical conduction to each other.

4. The rotary encoder of claim 1, wherein said movable contact point is provided with a plurality of contact tips which make contact with said contact-point board.

* * * * *